US010171930B1

(12) United States Patent
Brown

(10) Patent No.: US 10,171,930 B1
(45) Date of Patent: Jan. 1, 2019

(54) LOCALIZED AUDIBILITY SOUND SYSTEM

(71) Applicant: Kevin Brown, Milton, MA (US)

(72) Inventor: Kevin Brown, Milton, MA (US)

( * ) Notice: Subject to any disclaimer, the term of this patent is extended or adjusted under 35 U.S.C. 154(b) by 0 days.

(21) Appl. No.: 15/281,334

(22) Filed: Sep. 30, 2016

Related U.S. Application Data

(60) Provisional application No. 62/236,621, filed on Oct. 2, 2015, provisional application No. 62/347,582, filed on Jun. 8, 2016.

(51) Int. Cl.

| | |
|---|---|
| ***H04R 1/28*** | (2006.01) |
| ***H04R 5/02*** | (2006.01) |
| ***H04S 7/00*** | (2006.01) |
| ***H04R 3/12*** | (2006.01) |

(52) U.S. Cl.
CPC ..... *H04S 7/307* (2013.01); *H04R 1/2857* (2013.01); *H04R 3/12* (2013.01); *H04R 5/02* (2013.01); *H04R 2201/403* (2013.01); *H04S 2400/03* (2013.01); *H04S 2400/05* (2013.01)

(58) Field of Classification Search
CPC ..... H04R 1/025; H04R 1/026; H04R 1/20; H04R 1/2846; H04R 1/2853; H04R 1/30; H04R 1/323; H04R 1/326; H04R 1/34; H04R 1/38; G10K 11/02; G10K 11/18
USPC ..... 381/304, 305, 71.7, 71.4, 337, 338, 339, 381/346–348, 351–354
See application file for complete search history.

(56) References Cited

U.S. PATENT DOCUMENTS

2015/0071474 A1* 3/2015 Chick ..... H04R 1/2857 381/345
2015/0382090 A1* 12/2015 Bisset ..... H04R 1/2819 381/386

* cited by examiner

*Primary Examiner* — Norman Yu
(74) *Attorney, Agent, or Firm* — Lee Weinstein

(57) ABSTRACT

Several embodiments of a localized audibility sound system are disclosed. In an embodiment designed for persons playing a video game, configurations are disclosed which limit propagation of low-frequency sound to nearby areas or rooms, both for group and single-person play. Other embodiments are disclosed for use in trade shows and the like, which limit propagation sound to nearby booths and areas, while providing a rich audio experience for persons in a defined area. Embodiments for use in conference-calling are disclosed which facilitate selective telephonic transmission or recording of sounds spoken by persons around a conference table, while attenuating telephonic transmission or recording of other sounds created in the conference room such as typing on computer keyboards.

2 Claims, 10 Drawing Sheets

LOCALIZED AUDIBILITY SOUND SYSTEM

PRIORITY

This application claims priority to provisional patent application No. 62/236,621, filed Oct. 2, 2015, and provisional patent application No. 62/347,582, filed Jun. 8, 2016, which are herein incorporated by reference.

FIELD OF THE INVENTION

The field of the invention relates to audio speakers, video games, sound localization, and more specifically relates to focused or localized sound systems intended to be heard only within a defined area.

BACKGROUND OF THE INVENTION

Localizing sound to a predefined area is desirable in many situations, including playing video games, participating in teleconferences, giving presentations at trade shows, delivering narration for art exhibits, and many more analogous circumstances. Is some cases, it is practical to localize using walls (such as the walls of a conference room). In other situations, it may be practical to localize sound through the use of headphones or ear buds (such as are used for many systems that provide narration for art exhibits in museums), yet there are other situations (such as at trade shows) where walls are not an option for localizing sound. Additionally, there are situations where the level of sound isolation desired may not be achievable by walls alone. Applications such as video games may present further challenges where it is desirable not only to isolate sound from nearby areas (for instance areas where people may be sleeping), but where it is also desirable to provide directional cues so that certain sounds seem to come from a given direction, independent of the direction that a player's head may be turned.

The playing of video games is one of the most popular recreational activities in the world, with annual revenues exceeding 78.5 billion dollars in 2012. Video games are sometimes played by lone individuals and sometimes played by groups of individuals. When video games are played by a group of individuals, sometimes individuals are remote from each other and the game is played over a network, and sometimes the group of individuals are physically in the same room. A third possibility is that a group of individuals in the same room may be playing a video game over a network with other individuals or groups at remote locations.

One feature of many modern video games which is important to many gamers is the game's ability to create sounds which appear to come from or actually do come from different directions. One way this is done on many popular video games is to design the game's audio to be played through a "5.1" speaker system. Such speaker system has a front center audio driver, a front left audio driver, a front right audio driver, a rear left audio driver, a rear right audio driver, and a sub-woofer.

Sub-woofers known in the art are often one or more vibratile diaphragms coupled to room air on one side and to a sealed or ported enclosure on the other side. Alternately some sub-woofers known in the art are constructed as two acoustic transmission lines acoustically coupled to opposite sides of a vibratile diaphragm, as disclosed in U.S. Pat. No. 4,628,528 (Bose, et al., hereinafter Bose), which is herein incorporated by reference. The sub-woofer produces low-frequency sounds (for which directionality cannot be distinguished), so it may be placed anywhere in a room. The other drivers are positioned as described above so that the direction of origin of sounds which emanate from those speakers can be part of the virtual reality experience for a person playing the game.

It is common for one member of a household to be an avid video game player, while other members of the household may not be. As such, it is not uncommon within a household for a person playing a video game to want to have the sound of that video game turned up loud enough that people elsewhere in the house may find the sound distracting or disturbing. Low-frequency sound in particular travels relatively unimpeded through a home compared to higher frequency sounds.

While headphones or ear buds (both herein referred to as headphones) can partly address isolating sound that a person playing a video game hears, headphones have two disadvantages when it comes to realism of sound. First, although directionality can be experienced through headphones if the sound signals fed to the headphones are properly preprocessed through binaural processing, low-frequency sound is partly experienced through the body and partly experienced through the ears, so if the low-frequency sounds of a video game are played only through earphones, the body sensations of those low-frequency sounds will be lacking for the user. The second disadvantage of using headphones to experience sound directionality is that if one turns one's head, the direction the sound appears to be coming from changes, while if sound source direction comes from a speaker system (such as the "5.1" speaker system described above) which does not move when one turns one's head then a more realistic virtual reality is experienced by the user.

There is a need for an innovative video game sound system which can produce head-orientation-independent directionality and body-experienced low frequencies, while providing less sound propagation to nearby rooms than is possible with standard 5.1 sound systems.

While the above need may be partly met by simply moving the drivers of a standard 5.1 audio system close to the user, such a solution is inconvenient, and such a solution is not useful if a group of people are playing the video game together in the same room. As such, there is also a need for a realistic video sound system which will allow a group of people to play a video game together in the same room, each experiencing a high-quality audio virtual reality, while at the same time propagating less sound to nearby rooms than is possible with sound systems known in the art.

Trade show displays, in-store displays, and museum displays are further examples of applications where a localized audio experience is desired. In such situations, a person may be walking by an object of potential interest, and persons offering that object for sale or use or display may wish to provide an audio experience to augment the viewer's experience of the object or display. Such an audio experience might include a narrative, music, sound effects, or some combination of such audio. Some museums provide such audio through audio headsets worn by users and driven by battery-powered audio systems triggered by entering a code that goes with the object being viewed. U.S. Pat. No. 5,532,438 to Brown (hereinafter Brown) discloses a sound localization system employing a dome-shaped acoustic reflecting element to focus stereo sound to a users ears when the user's head is positioned in a predetermined place and orientation. There is a need for innovative technologies which provide localized sound such as might be used to accompany an object or display, without the need for headphones, in a way that provides the possibility for multiple persons standing within an area to hear approximately the same audio, and in a way that localizes bass as well as higher frequency sounds.

SUMMARY OF THE INVENTION

It is an object of the present invention to provide a video game sound system which can produce head-orientation-independent directionality, and body-experienced low frequencies, while providing less sound propagation to nearby rooms than is available through standard 5.1 sound systems. It is a further object of the present invention to provide a non-headphone sound system which enables the user to perceive sounds coming from any direction around the user, while propagating far less acoustic energy to nearby areas or rooms than would a standard 5.1 sound system. It is a further object of the present invention to provide localized sound such as might be used to accompany an object or display, without the need for headphones.

In one aspect, the present invention provides a speaker system which is easily mechanically reconfigurable between two different operating modes: a "multi-user mode" and a "private mode". In one preferred embodiment, multi-user mode is implemented using two front speakers placed on opposite sides of the user or users, a center front speaker, two rear speakers placed on opposite sides of the user or users, and a sub-woofer, which is preferably a transmission-line-type sub-woofer according to one of two possible innovative aspects of the present invention. In this preferred embodiment, a user may switch to private mode by moving the sound exit ports of the transmission-line-type sub-woofer to be close to the user, so that far less power is required for the sub-woofer, and far less low-frequency sound propagates to nearby rooms.

In an alternate preferred embodiment, front left and right speakers are not needed, and rear left and right speakers are positioned on opposite sides of the user not far behind the user, or may be directly to the left and right of the user. In this mode, left and right directionality of sound is produced by varying the volume of the left speaker vs. the right speaker for a given sound, and front and back directionality is perceived through binaural processing of a standard set of 5.1 sound sources through digital signal processing, to reduce the 5 mid-to-high frequency speaker signals and one sub-woofer signal to three mid-to-high frequency sources and one sub-woofer signal.

With binaural processing, although all mid-frequency and high-frequency sounds come from either a left speaker or a right speaker, the binaural processing puts amplitude increases and decreases at certain frequencies (referred to as front directional cues) into the sounds that would have come from in front of the user, to mimic the amplitude changes at those frequencies that sound heard at the eardrums of the user would have if the sound had traveled around the front part of the user's head and the front part of the outer ear. Binaural processing also puts different amplitude increases and decreases at certain frequencies (referred to as rear directional cues) into the sounds that would have come from behind the user, to mimic the amplitude changes at those frequencies that sound heard at the eardrums of the user would have if the sound had traveled around the rear part of the user's head and the rear part of the outer ear. In this embodiment, left/right directional queues are picked up by the user from sound intensity on left vs. right, and front/back directional queues are perceived through spectral shaping accomplished through digital signal processing.

In this alternate preferred embodiment, private mode is accomplished by swiveling the left and right rear sound sources closer to the user's head (though still maintaining one mid-to-high-frequency source on the right, and one on the left), simultaneously repositioning the sub-woofer transmission line exit ports close to the users head, and further operating the front center speaker as a focused horizontal array, so that the sound it projects in the direction of the user is more intense than the sound it projects in other directions. Thus in private mode of this embodiment, far less sound power needs to be emitted from all acoustic drivers in the system for a single user to experience a given sound volume compared with standard 5.1 systems.

In a second aspect, the present invention provides a means for a person listening to audio to have a more realistic body-experience of the low-frequency portion of sound he or she is listening to under conditions where the whole body is not being driven by the pressure field of a sub-woofer or the like (for instance when headphones are being used). In a preferred embodiment, vibratile energy is transferred to a user's body through a partially hollow compliant mat whose hollow internal space acts as part of the contained air volume of a sub-woofer, and directly transmits vibratile energy to a user through mechanical contact with the user.

In a third aspect, the present invention provides means for providing a realistic audio experience (including low frequencies) to a person playing a video game in a room, without headphones, while propagating far less low-frequency audio energy to nearby rooms than is possible using conventional sound systems. In a preferred embodiment, a user is seated in a room containing a sub-woofer coupled to the room through one or more open-ended acoustic transmission lines whose open end is placed close to the user's head, so that the user is in the very near field of the sub-woofer sound source, so that the source does not have to be driven with much power for the user to experience loud bass sound. Thus far less low-frequency energy propagates to nearby rooms, than would propagate if the sub-woofer exit port were further from the user's head and thus had to be louder.

In a fourth aspect, the present invention provides a novel sound-localizing sub-woofer in the form of a quad-transmission-line speaker useful over a two-octave frequency range, the sound phases from whose four exit ports serve to reinforce low-frequency sounds for persons near the unit, but where low-frequency sounds from the four exit parts largely cancel farther from the quad-transmission-line speaker.

In a fifth aspect, the present invention provides a dual-transmission-line sub-woofer which provides near-field reinforcement of low-frequency sounds, while providing far-field cancellation of a narrow range of frequencies along its axis.

In a sixth aspect, the present invention provides a novel sound-localizing sub-woofer in the form an integer number of pairs of acoustic sources, each source band-limited to produce a band of frequencies spanning less than one octave, wherein such band of frequencies is centered on a frequency whose wavelength is twice the distance between that pair of acoustic sources.

DETAILED DESCRIPTIONS OF SOME PREFERRED EMBODIMENTS

Embodiments of the present invention may use one of two preferred embodiments of sound-localizing subwoofers when configured for group listening, and one of several other embodiments of subwoofers when configured for individual listening. All such subwoofer embodiments are designed to minimize propagation of low-frequency sound outside the intended listening area.

Figure 1A:
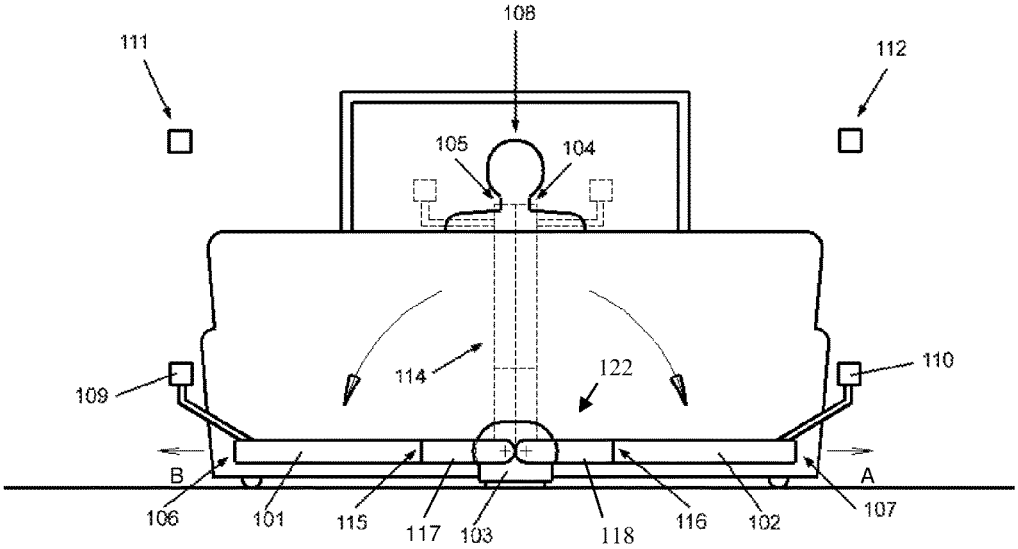
FIG. 1*a* depicts a rear view of a speaker system according to the present invention employing a quad-transmission-line sub-woofer which can be configured either in "multi-user mode" (solid lines) mode or in "single-user mode" (dotted lines).
Figure 1B:
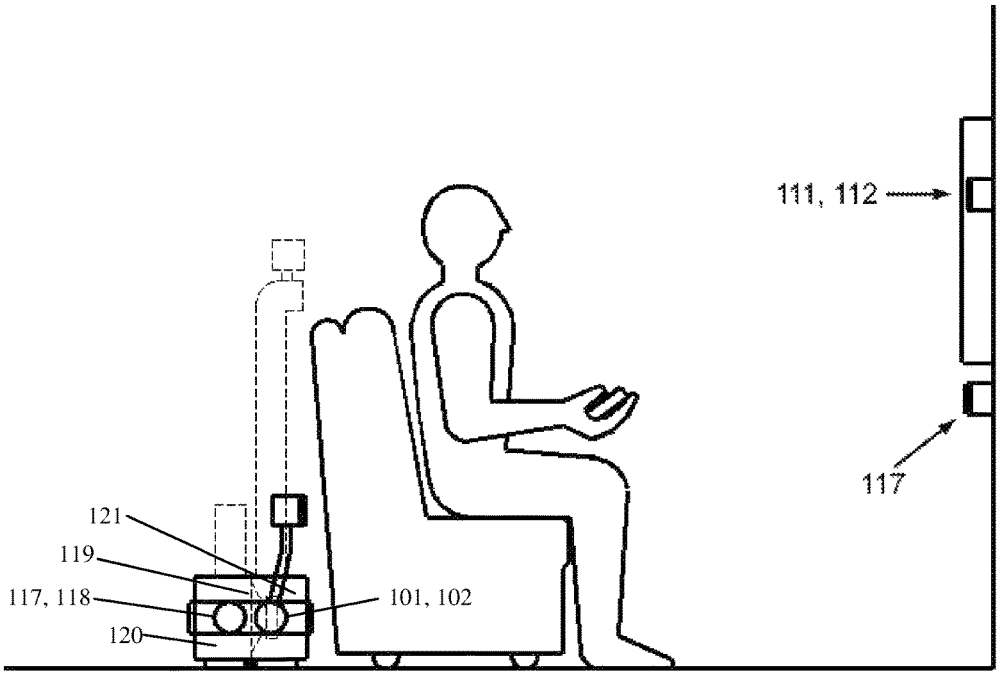
FIG. 1*b* depicts a side view of the speaker system shown in FIG. 1.

FIG. 1*a* is a rear view of a person seated on a couch (for instance to play a video game), with a subwoofer according to one aspect of the present invention positioned behind the couch. A side view of the embodiment depicted in FIG. 1*a* is depicted in FIG. 1*b*. A top view of such subwoofer of FIGS. 1*a* and 1*b* is depicted in FIG. 3.

The subwoofer of such a preferred embodiment is a quad-acoustic-transmission-line subwoofer consisting of a vibratile diaphragm 119 having a front side and a back side, acoustically coupled on its front side to chamber 120, and acoustically coupled on its back side to chamber 121. Chamber 120 is ported to the listening area through acoustic transmission lines 117 and 118, shown as round hollow tubes terminating at open ends 115 and 116, respectively. Chamber 121 is ported to the listening area through acoustic transmission lines 101 and 101, shown as round hollow tubes terminating at open ends 106 and 107, respectively. In a preferred embodiment, chambers 120 and 121 have the same cross-sectional area as each other, and the same cross-sectional area as acoustic transmission lines 101, 012, 117, and 118. In a preferred embodiment, the distance between transmission line end points 115 and 116 is approximately one half the distance between transmission line end points 106 and 107.

Figure 3:
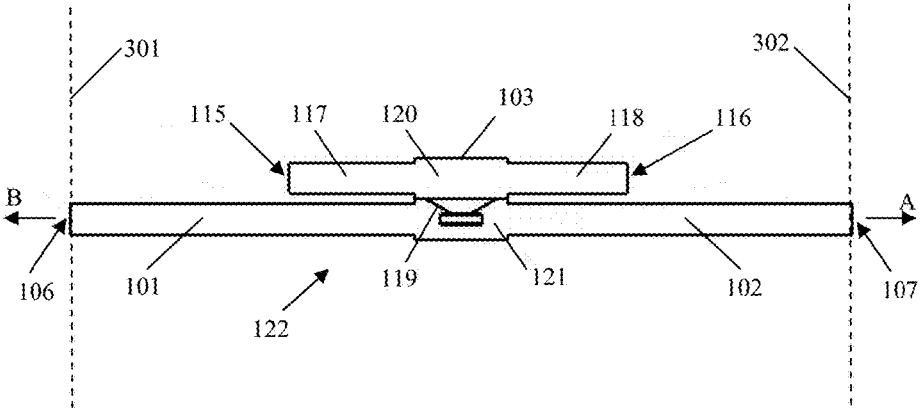
FIG. 3 depicts a quad-transmission-line sub-woofer according to one aspect of the present invention, with the four transmission line exit ports labeled to correspond to use in "multi-user mode" in FIG. 1.

In preferred embodiments, the frequencies reproduced by the subwoofer shown in FIGS. 1*a*, 1*b*, and 3 span a range of between 2 and 3 octaves. In directions perpendicular to the A-B axis of the sub-woofer depicted in FIGS. 3 & 1*a*, acoustic pressure waves emanating from transmission line ends 106, 107, 115, and 116 are in phase and reinforce one another between dotted lines 301 and 302 (see FIG. 3), but largely cancel out in the far field in directions A and B. Thus, in a video game use as shown in FIG. 1*a*, far less acoustic energy from subwoofer 121 propagates to other rooms that might be in a house in directions A and B than would propagate from use of a conventional sub-woofer.

A preferred embodiment of the present invention may be switched between multi-user and single-user mode, as depicted in FIGS. 1*a* and 1*b*, where the solid-line depiction of sub-woofer 122 is a preferred configuration used in multi-user mode, and the dotted-line depiction of sub-woofer 122 is a preferred configuration used in single-user mode. In such a mechanically reconfigurable embodiment, acoustic transmission lines 101 and 102 are shown pivotally attached to driver module 103, such that the ends of acoustic transmission lines 101 and 102 which couple to the room air may be located at positions 104 and 105 in a single-user configuration, and at positions 106 and 107 in a multi-user configuration.

In an alternate reconfigurable embodiment, one or more of transmission lined 101, 102 might be flexible, or extendible, reconnectable, or some combination thereof to accomplish the repositioning of the ends of the transmission lines that couple acoustic energy to the room from positions 104 and 105 to positions 106 and 107. We shall use the phrase "pivotally attached" to describe all such acoustic transmission lines 101 and 102 which are each driven by a common driver module 103 and reconfigurable such that the transmission line ends that couple to the room air may be set to positions such as 104 & 105 or positions such as 106 and 107.

In the configuration where transmission lines 101 and 102 are configured such that their ends that couple to the room are at positions 104 and 105, the user's head is in the near field of the sub-woofer acoustic source, and thus the drive level of the sub-woofer may be reduced substantially while still maintaining the needed acoustic loudness for one individual. When the present invention is configured and adjusted in this way, low-frequency energy transmitted to nearby rooms in all directions is substantially reduced. In such a configuration, mid-to-high frequency acoustic drivers 109 and 110 are also closer to the user's head, so drive levels to these drivers may be reduced as well.

In a preferred single-user embodiment, front center audio driver 201, left front audio driver 111, and right front audio driver 112 are each focused array drivers, which focus acoustic energy in the direction of the user. In such an embodiment, the ability to maintain virtual reality sound directionality is maintained independent of whether the user turns his or her head, maintaining the this advantage over the use of headphones, and the amount of acoustic energy from all drivers which propagates to nearby rooms is substantially reduced over standard 5.1 audio systems.

Figure 4:
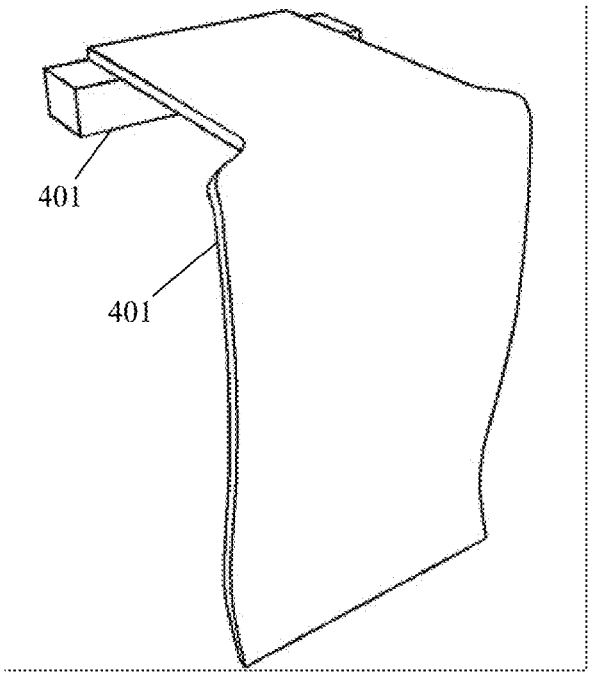
FIG. 4 depicts a low-frequency vibratile mat which acts as a body-contact sub-woofer in one aspect of the present invention.
Figure 5:
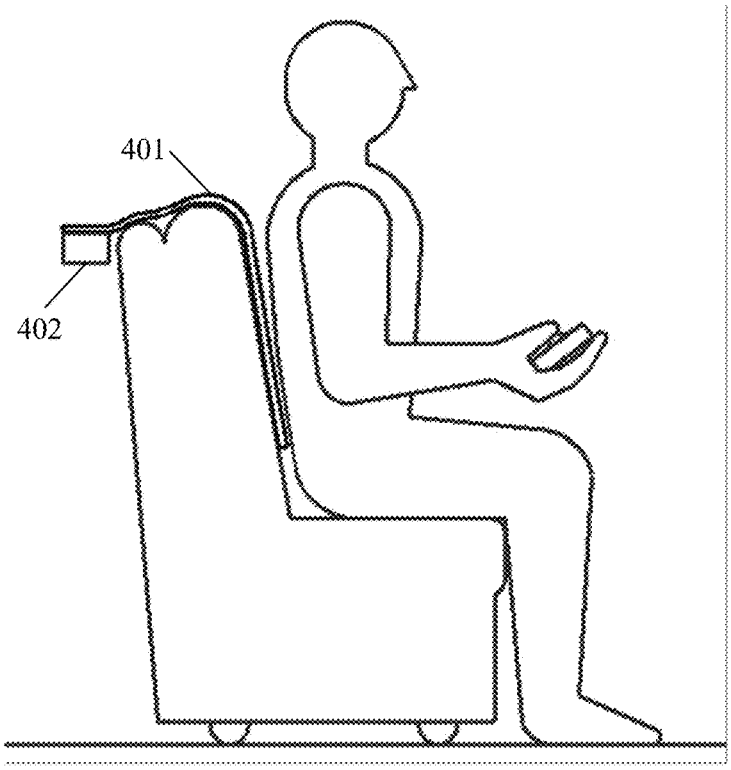
FIG. 5 depicts the low-frequency vibratile mat of FIG. 4 positioned in contact with a users body as it would be when the user uses the present invention.
Figure 6:
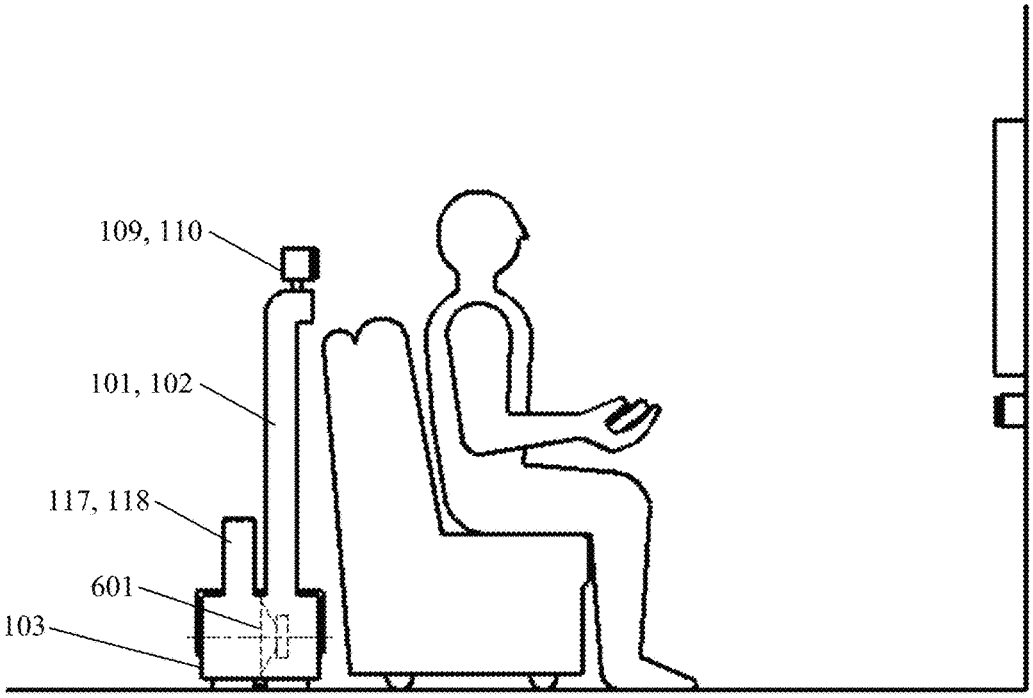
FIG. 6 depicts a side view of the embodiment of FIG. 1, configured in "single-user" mode.

FIG. 4 depicts an acoustic vibratile mat according to one aspect of the present invention. In a preferred embodiment, housing 401 contains a sub-woofer vibratile driver which in part couples low-frequency acoustic energy to a hollow space within mat 401. As depicted in FIG. 5, a seated user whose back rests against mat 401 will feel low-frequency energy coupled to his or her body, thus providing sensory realism if headphones are used. As an alternative to using headphones, one or more acoustic ports may be provided on driver housing 402, providing audible low-frequency sound such that the user's head is in the near field and thus volume in the far field can be kept low while still providing body vibration through hollow mat 401.

Figure 8:
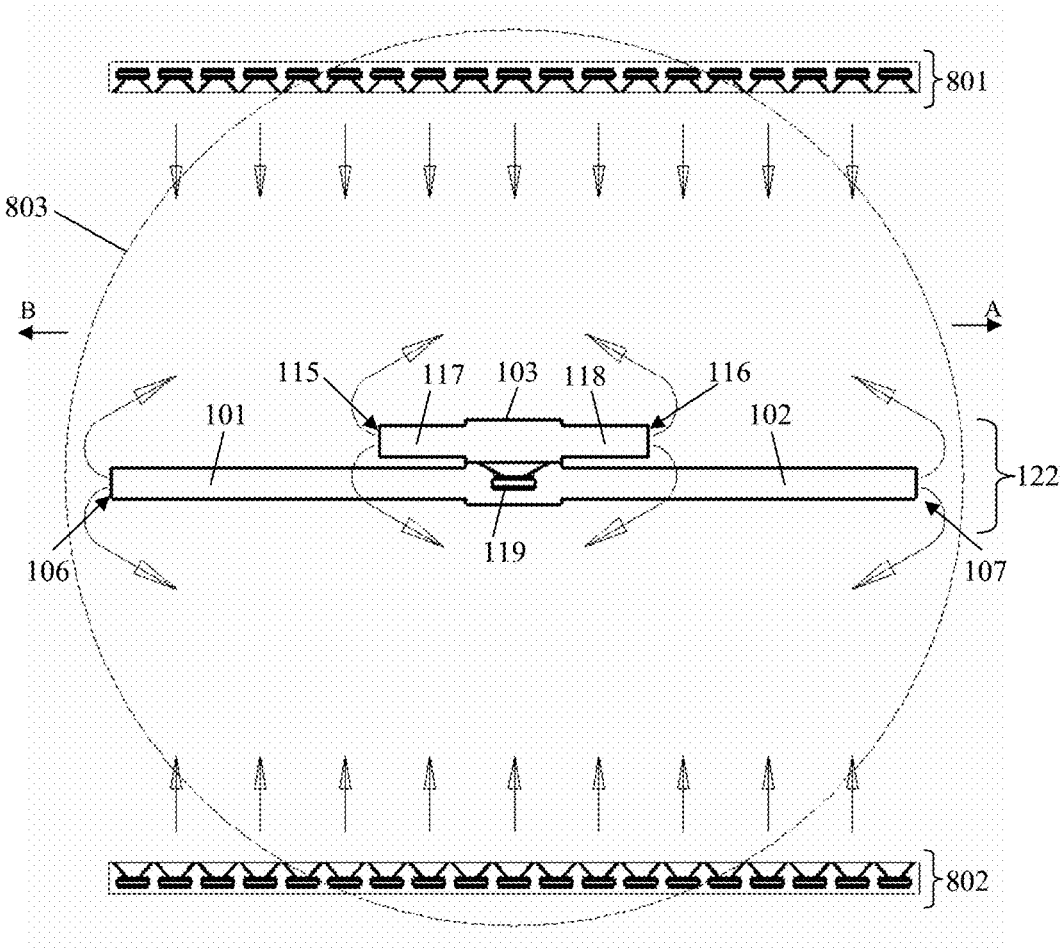
FIG. 8 depicts a preferred embodiment for use in creating a localized sound field for audio presentations at trade shows.

A preferred embodiment for use in creating a localized sound field for audio presentations at trade shows and the like is depicted in FIG. 8. In a preferred embodiment, linear acoustic driver arrays 801 and 802 are constructed of a plurality of like drivers, and produce mid and high audible frequencies, while sub-woofer 122 produces low-frequency audio. In a preferred embodiment, driver arrays 801 and 802, and sub-woofer 122 are suspended above listeners (for instance above a trade show booth). While acoustic intensity falls off as the inverse square of the distance from a theoretical point-source driver, acoustic intensity falls off as only the inverse of the distance perpendicular to a linear array driver. Thus linear array drivers 801 and 802 serve to provide a uniform-intensity audio field (depicted as hollow-point straight arrows in FIG. 8) in the mid and high frequency in the space between linear arrays 801 and 802 (approximated by circle 803 in FIG. 8).

As described above, acoustic energy (depicted as curved hollow-point arrows in FIG. 8) from exit ports 106, 107, 115, and 116 of subwoofer 122 reinforce one another within circle 803, providing uniform low-frequency sound, while in the far field in directions A and B, acoustic signals from exit ports 106, 107, 115, and 116 tend to cancel.

Figure 12:
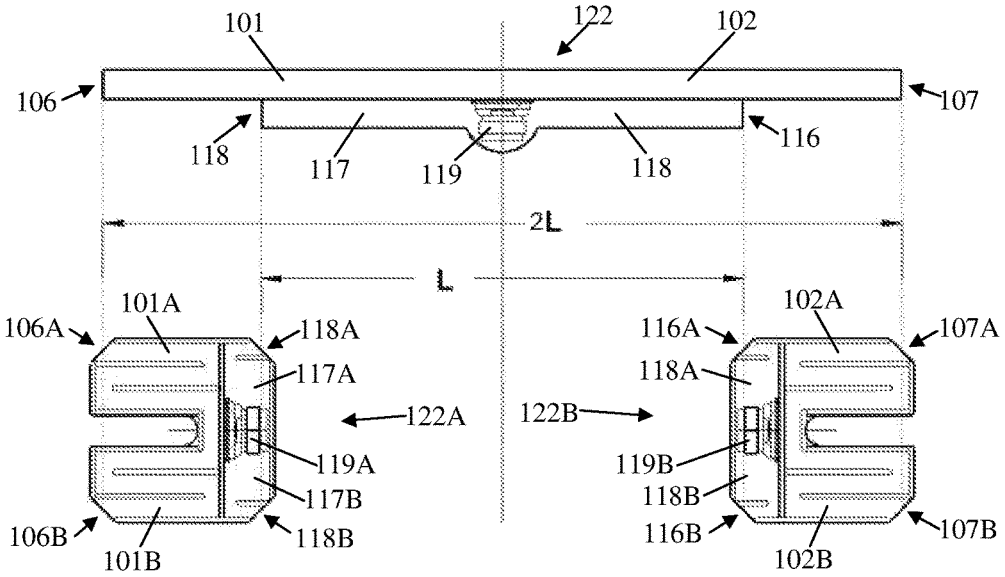
FIG. 12 depicts an alternate embodiment of the phased acoustic source 103 shown in FIG. 8.

In situations where overhead placement of subwoofer 122 is impractical or undesirable, an alternate embodiment of subwoofer 122 may be employed by replacing overhead subwoofer 122 with dual subwoofers 122A and 122B (which may be at floor level), as shown in FIG. 12. In such an alternate embodiment, drivers 119A and 119B are driven with the identical signal that would have been used to drive driver 119 in subwoofer 122. In such an alternate embodiment, subwoofers 122A and 122B must be spaced apart approximately as shown in FIG. 12, so that the summed sound pressure waves exiting from acoustic ports 116A and 116B have the same amplitude and phase as the sound signals that would exit from acoustic port 116, and the summed sound pressure waves exiting from acoustic ports 115A and 115B have the same amplitude and phase as the sound pressure waves that would have exited from acoustic port 115, and the summed sound pressure waves that exit from acoustic ports 106A and 106B have the same amplitude and phase as the sound pressure waves that would have exited from acoustic port 106, and the summed sound pressure waves that exit from acoustic ports 107A and 107B have the same amplitude and phase as the sound pressure waves that would have exited from acoustic port 107.

Thus when subwoofers 122A and 122B are spaced apart as shown in FIG. 12 so that the distance between acoustic ports 106A and 107A is the same as the distance between acoustic ports 106B and 107B, and the same as the distance between acoustic ports 106 and 107 on subwoofer 122, and when the distance between acoustic ports 115A and 116A is the same as the distance between acoustic ports 115B and 116B, and the same as the distance between acoustic ports 115 and 116 on subwoofer 122, and when drivers 122A and 122B are driven by the same signal that would have driven driver 119, the sound fields set up by the combination of subwoofers 122A and 122B is essentially identical to the sound field produced by subwoofer 122.

When dual subwoofers 122A and 122B are used to replace subwoofer 122 as shown in FIG. 12, parallel folded acoustic transmission lines 102A and 102B each have the same length as acoustic transmission line 102, and folded parallel acoustic transmission lines 101A and 101B each have the same length as acoustic transmission line 101, and folded acoustic transmission lines 118A and 118B each have the same length as acoustic transmission line 118, and parallel folded acoustic transmission lines 117A and 117B each have the same length as acoustic transmission line 117.

Figure 13:
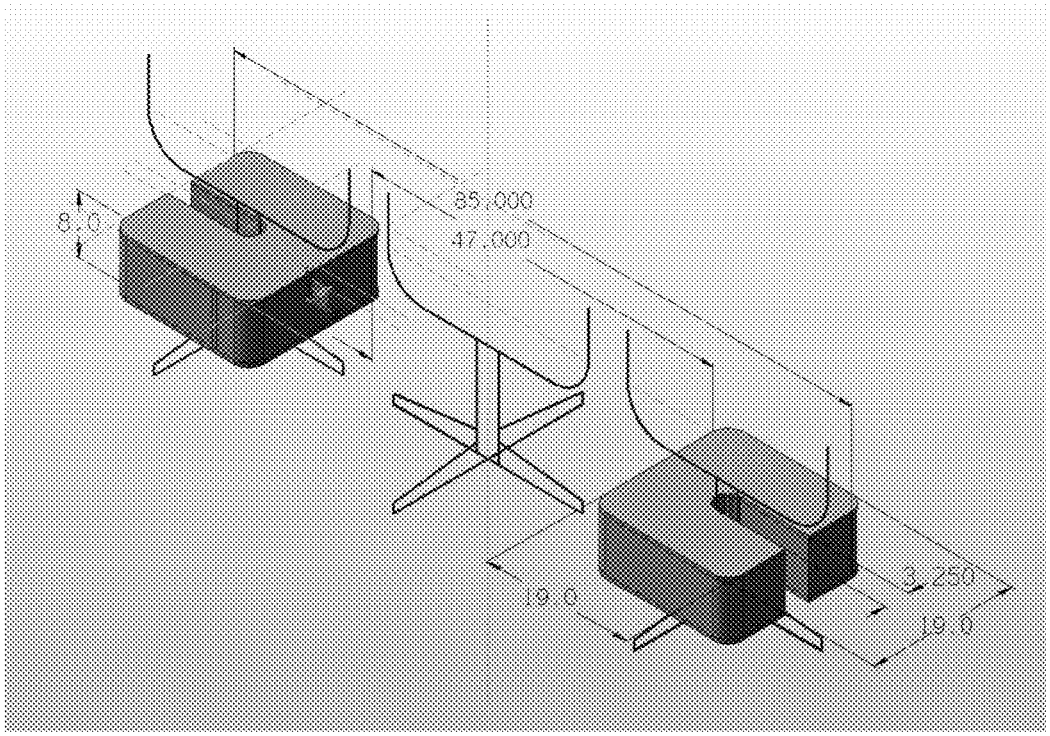
FIG. 13 is a perspective view of the embodiment depicted in FIG. 12.

Subwoofers 122A and 122B are designed to slide into place around the cylindrical support columns of two chairs placed the correct distance apart (as shown in FIG. 13), as may be convenient in a trade show booth or similar area within which a localized sound field is desired. Configuring subwoofers 122A and 122B in this way allows the creation of the desired localized sound field, without the need to suspend subwoofer 122 overhead, and allows the floor space between subwoofers 122A and 122B to remain clear (which placing subwoofer 122 on the floor would not allow).

Figure 9:
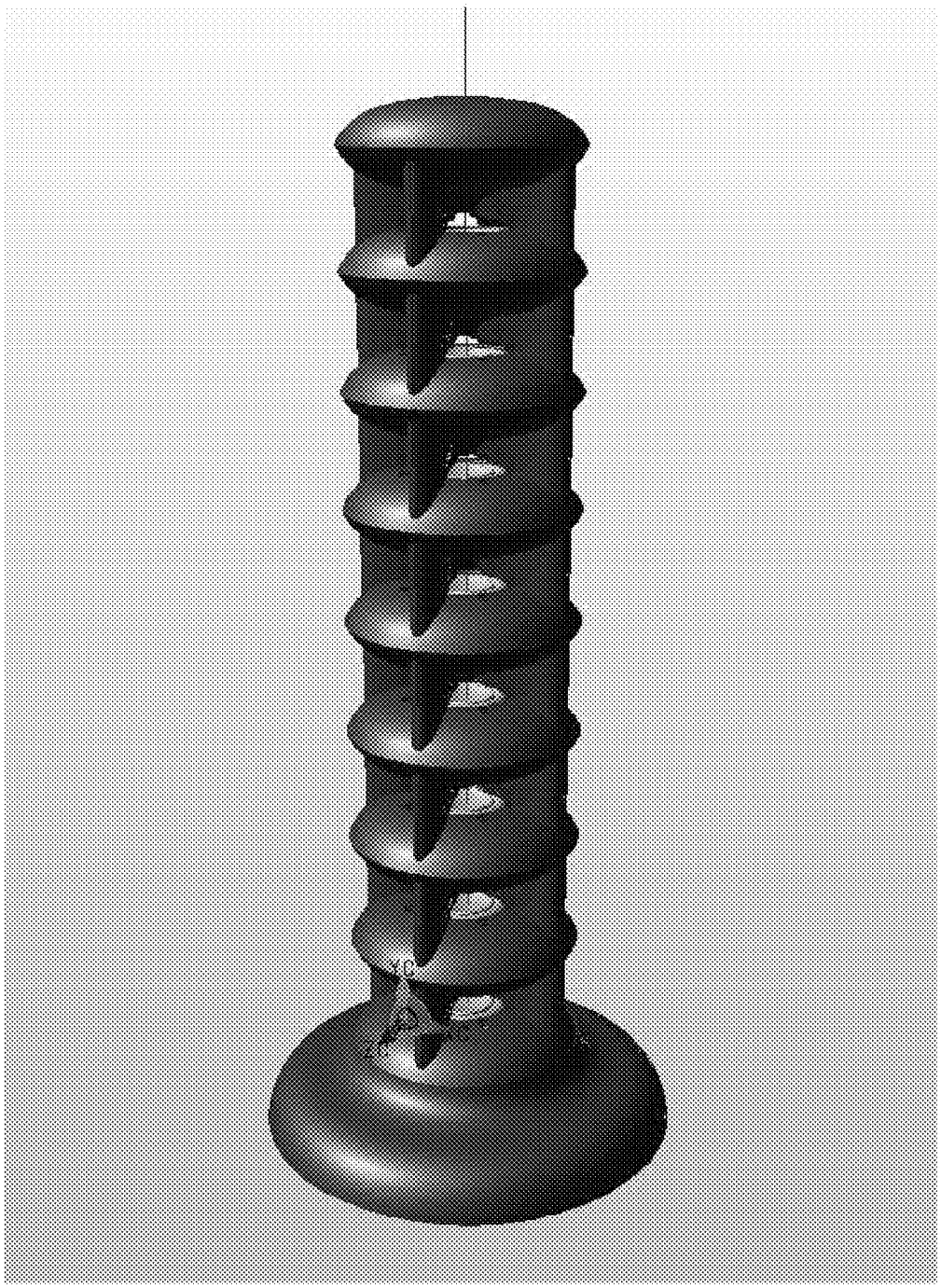
FIG. 9 is a perspective view rendering of a table-top embodiment of the present invention which may be used in microphone or speaker mode, employing 8 phased acoustic transducers to project sound to a toroidal volume around a conference table, or listen to sound coming from that toroidal volume.
Figure 10:
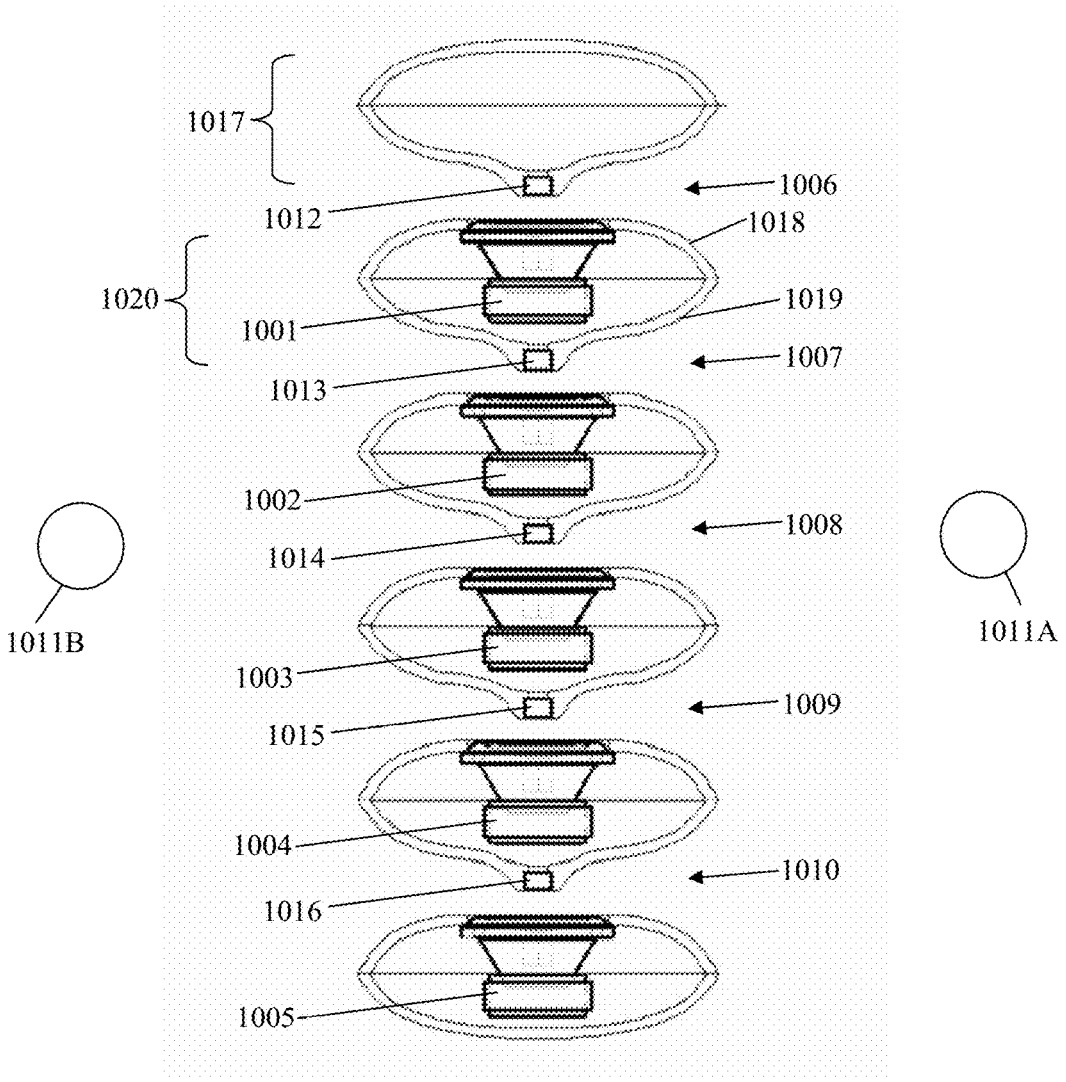
FIG. 10 is a cross sectional view through the Y axis (vertical axis) of a 5-driver embodiment of the present invention analogous to the 8-driver embodiment shown in FIG. 9.

FIG. 9 is a perspective view rendering of a table-top embodiment of the present invention which may be used in microphone or speaker mode, employing 8 phased acoustic transducers to project sound to a toroidal volume around a conference table, or listen to sound coming from that toroidal volume. FIG. 10 10 is a cross sectional view through the Y axis (vertical axis) of a 5-driver embodiment of the present invention analogous to the 8-driver embodiment shown in FIG. 9. Circles 1011A and 1011B represent cross-sections of a toroidal volume centered around acoustic driver array 1012. In this embodiment, acoustic transducers 1001-1005 are housed in horn pods such as horn pod 1020, and one more similar horn pod 1017 without transducer caps the array.

In the embodiment shown in FIG. 10, the upper surface of a given horn pod containing a given acoustic transducer acts as the lower surface of the acoustic horn waveguide which guides acoustic energy to and from that given acoustic transducer, and the lower surface of the horn pod placed above that given horn pod acts as the upper surface of the acoustic horn waveguide which guides acoustic energy to and from that given acoustic transducer. For instance, upper horn pod surface 1018 serves as the lower surface of the circular horn waveguide which guides acoustic energy to and from acoustic transducer 1001, and lower horn pod surface 1019 serves as the upper surface of circular horn waveguide which guides acoustic energy to and from acoustic transducer 1002.

Figure 11:
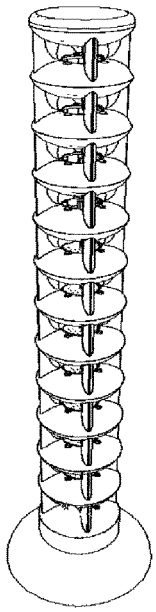
FIG. 11 is a photograph of a partly assembled 12-driver embodiment of the invention analogous to the 8-driver rendering depicted in FIG. 9.

In order to simplify FIG. 10, the structural pieces which link the horn pods and carry wires to acoustic drivers 1001-1005 and microphones 1012-1016 are not shown, though those structures are shown in the rendering of FIG. 9 and the photograph of FIG. 11.

In the idealized embodiment shown in FIG. 10, the horn pods containing acoustic driver transducers 1001-1005 are aligned along a first Cartesian coordinate, such that the sound fields projected from each acoustic driver transducer is circularly symmetric within the plane defined by second and third Cartesian coordinates. When support structures are introduced to join the array of horn pods together (as shown in the rendering of FIG. 9 and the photograph of FIG. 11), the projected sound field is no longer circularly perfectly symmetric. In a preferred embodiment such as shown in FIGS. 9 and 11, circular uniformity of the sound field from each acoustic driver transducer (and thus the acoustic sensitivity pattern of each of microphones 1012-1016) are maintained within plus or minus 15%.

While the embodiment of the present invention shown in FIGS. 9-11 utilizes and array of acoustic drivers where each driver directs sound energy in a circularly approximately uniform pattern, in alternate embodiments, each driver in FIG. 10 may be replaced with multiple drivers driven in phase. For example, in an alternate embodiment, the stack of horn pods shown in FIG. 10 could be replaced by a cylinder, where at the level of the cylinder analogous to the level of a given horn pod, multiple acoustic drivers (for instance 3 drivers) evenly spaced about the circumference of the cylinder are driven by the same signal by which the driver within the horn pod at that level would have been driven. In such an embodiment, more drivers around the circumference at a given level produces a more circularly uniform sound field. Likewise, multiple summed microphones at each such level may be summed to create nearly circularly uniform sound sensitivity. In utilizing multiple microphones at every level, microphones at a given level may be amplified with different gains before summing, thus allowing selective listening to different section of the toroidal volume whose cross-section is indicated by circles 1011A and 1011B.

Acoustic drivers 1001, 1002, 1003, 1004, and 1005 project sound through circular horn apertures 1006, 1007, 1008, 1009, and 1010, respectively. When the signals fed to drivers 1002, 1005, 1001, and 1004 are identical to the signal fed to driver 1003, but delayed with respect to the signal fed to driver 1003 such that the arrival times of a given wave front from drivers 1002, 1005, 1001, and 1004 at circles 1011A and 1011B are identical, then sound pressure wave fronts from all drivers reinforce one another within the toroidal volume whose cross section is represented by circles 1011A and 1011B. Likewise, when acoustic drivers 1001, 1002, 1003, 1004, and 1005 are used as microphones and like delays are used in combining signals from drivers 1001, 1002, 1003, 1004, and 1005, then the drivers operate as a focused array which preferentially listens to sound coming from the toroidal volume whose cross-section is represented by circles 1011A and 1011B.

Figure 14:
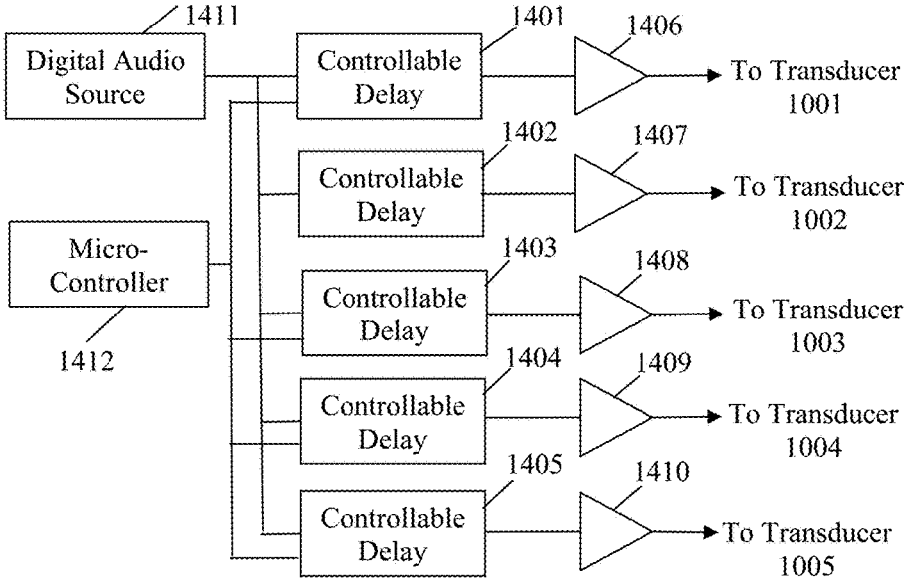
FIG. 14 is a block diagram of the circuitry used in a preferred embodiment of the present invention to drive the transducers of the phased circular horn array depicted in cross-section in FIG. 10.

FIG. 14 is a block diagram of the circuitry used in a preferred embodiment of the present invention to drive the drivers of the phased circular horn array depicted in cross-section in FIG. 10. Digital audio source 1411 provides identical digital audio to controllable digital delay modules 1401-1405. The delays of digital delay modules 1401-1405 are each separately configured by Micro-Controller module 1412, which preferably contains non-transitory computer-readable medium containing program instructions, random-access memory, a microprocessor or digital signal processor (DSP), and input/output interface which interfaces with both user controls and controllable delay modules 1401-1405. Amplifier modules 1406-1410 each contain digital-to-analog (D/A) converters and driver amplifiers for driving acoustic transducers (audio drivers) 1001-1005, respectively. In some embodiments the D/A function and amplifier function of each of modules 1406-1410 may be subsumed into a switching power amplifier.

Figure 15:
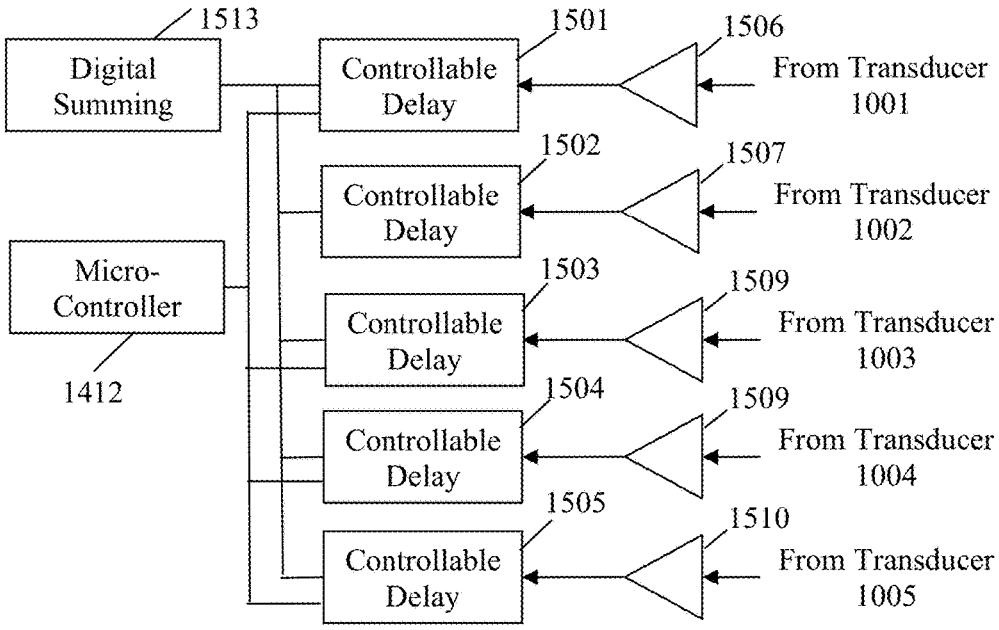
FIG. 15 is a block diagram of circuitry used in a preferred embodiment of the present invention to receive signals from the transducers of the phased circular horn array depicted in cross-section in FIG. 10 as a microphone array that preferentially listens to sound originating within a toroidal volume of space.

FIG. 15 is a block diagram of circuitry used in a preferred embodiment of the present invention to receive signals from the transducers of the phased circular horn array depicted in cross-section in FIG. 10 as a microphone array that preferentially listens to sound originating within a toroidal volume of space. Note that audio signal flow in FIG. 15 is from right to left, while control signal flow is from left to right. Signals from microphone amplifiers 1506-1510 are amplified and converted to digital signals by amplifier & analog-to-digital modules 1506-1510, and delayed by individually programmed digital delay modules 1501-1505, and the resultant delayed signals are summed in summing module 1513 to produce an audio stream which preferentially listens to audio sources within the toroidal volume whose cross-section is represented by circles 1011A and 1011B in FIG. 10.

In a preferred embodiment, the toroidal volume preferentially listened to by combining the circuitry of FIG. 15 with the transducer array of FIG. 10 is the toroidal volume in a conference room that contains the heads of the participants. Thus noises coming from chairs moving, people typing on computer keyboards, equipment fans, etc. are attenuated compared to audio signals picked up from conference participants talking.

While utilizing acoustic transducers 1001-1005 as both microphones and speakers is practical for implementing a half-duplex speaker phone, it may be impractical for implementing a full-duplex speaker phone. Thus in a preferred embodiment, microphones 1012-1016 are included as shown in FIG. 10, and the signals from these microphones feed amplifiers 1506-1510, respectively.

Figure 16:
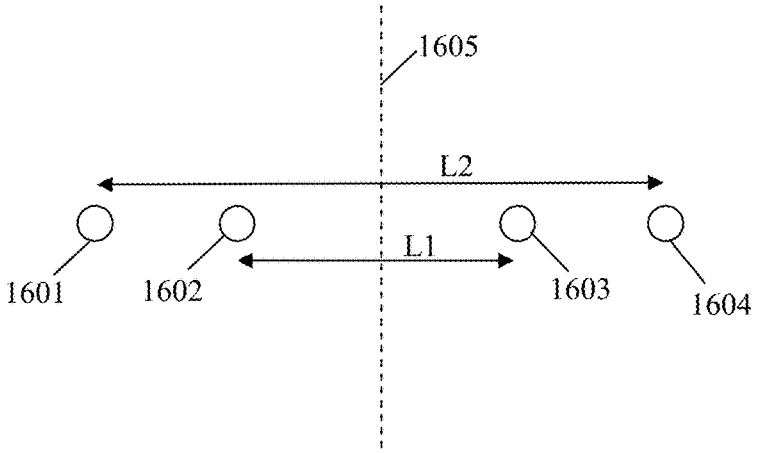
FIG. 16 depicts an alternate embodiment in which four approximately linearly aligned acoustic sources are driven as two pairs of acoustic sources, each symmetrically disposed about a line of symmetry.

In an alternate low-frequency-localization embodiment of the present invention depicted in FIG. 16, an arrangement of four approximately linearly aligned acoustic sources 1601, 1602, 1603, and 1604 may be driven as two pairs of sources each symmetrically disposed about line of symmetry 1605. Looking first at the pair separated by distance L1, we see that for frequencies in the range of the frequency at which L1 is a half wavelength, if source 1602 is driven by the same signal as source 1603, then in the area between sources 1602 and 1603 (and all along line of symmetry 1605), the acoustic waves from the two sources tend to reinforce one another, and in areas far to the left of source 1602 or far to the right of source 1603, the acoustic waves from the two sources tend to cancel one another.

Likewise, looking first at the pair separated by distance L2, we see that for frequencies in the range of the frequency at which L2 is a half wavelength, if source 1601 is driven by the same signal as source 1604, then in the area between sources 1601 and 1604 (and all along line of symmetry 1605), the acoustic waves from the two sources tend to reinforce one another, and in areas far to the left of source 1601 or far to the right of source 1604, the acoustic waves from the two sources tend to cancel one another.

Thus multiple pairs of acoustic sources may be used to localize multiple narrow-frequency-band sound fields, which may be summed to provide localization of a wider band of frequencies than is possible from a single pair of acoustic sources. Viewed as a special case of such an embodiment, the dual-subwoofer embodiment of the present invention shown in FIGS. 12 and 13 may be thought of as using only two acoustic drivers to synthesize two pair of narrow-resonance acoustic sources, One pair spaced apart by distance L1 and one pair spaced apart by distance L2.

Figure 2:
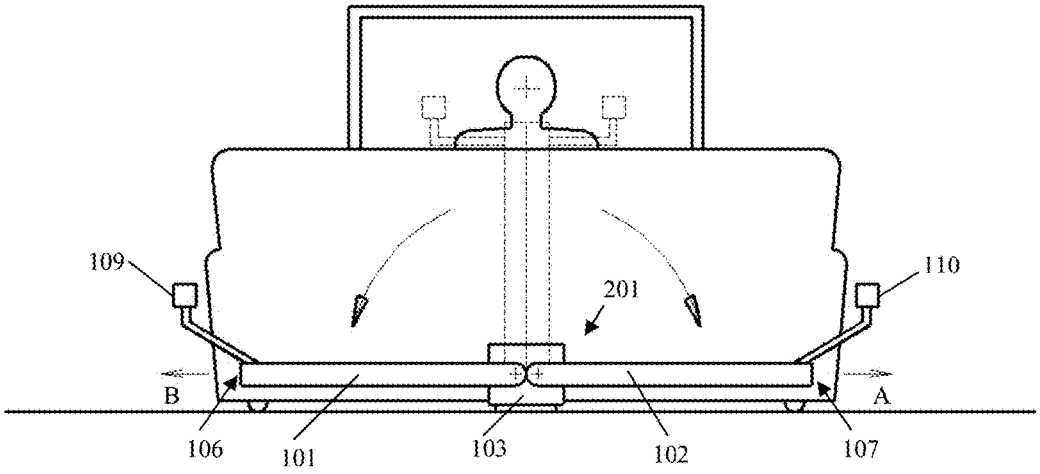
FIG. 2 depicts a rear view of a speaker system according to the present invention employing a dual-transmission-line sub-woofer which can be configured either in "multi-user mode" or in "single-user mode".
Figure 7:
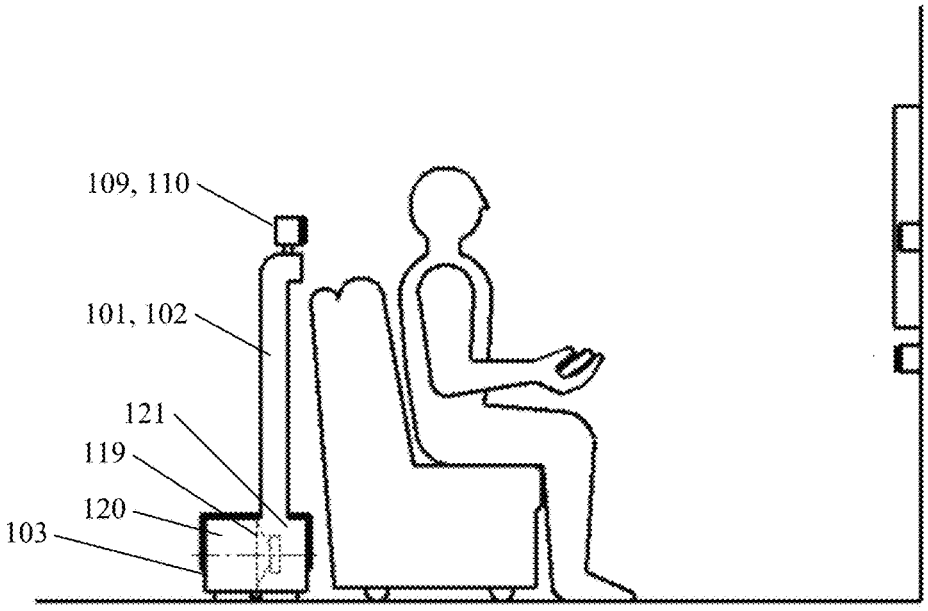
FIG. 7 depicts a simplified embodiment of the sub-woofer shown in FIG. 3.

In a simplified embodiment of the sub-woofer shown in FIG. 3, enclosure volume 120 is sealed as shown in FIG. 7. In such an embodiment, the sub-woofer has only two ports (ports 106 and 107), which are at the ends of acoustic transmission lines 101 and 102. Such an embodiment does not have as wide a bandwidth over which far-field acoustic waves in directions A and B cancel, but for frequencies at which the distance between exit ports 106 and 107 is one half wavelength, cancellation will be very good in the far field in directions A and B. A sub-woofer 201 according to such simplified embodiment is shown in FIG. 2, with solid lines representing multi-user configuration, and dotted lines representing single-user configuration. A side view of such embodiment is shown in single-user configuration in FIG. 7.

Within this document, the term "approximately" shall be construed to mean "within 15% of", except when used in the phrase "approximately collinear", and the term "equidistant" shall be construed to mean "within 10% of identical distance", and the term "roughly" shall be construed to mean "within 30% of".

Within this document, the term "approximately collinear", when used to describe a set of points will have the following meaning: assuming a line segment ending at the two points of the set which are furthest from each other, the angular coordinates of all points in the set shall be assumed to be approximately collinear if all said angular coordinate from the center to each point is within pi/7 radians of the angular coordinate to the closest end point of the line segment in every plane which contains the line segment.

Within this document, binaural processing of signals shall be assumed to be carried out through digital signal processing carried out on a programmable digital computing device such as a microprocessor or digital signal processor (all of which shall herein be referred to as a digital signal processor or DSP), under control of program instructions encoded in a non-transitory digital medium such as flash memory or read-only memory or a hard disk or the like.

Within this document, it is not assumed that each acoustic source requires a separate acoustic driver. An acoustic source may be an aperture of an acoustic transmission line or aperture of an acoustically resonant chamber, and thus multiple acoustic sources may be driven by a single acoustic transducer such as an electromechanically driven vibratile diaphragm.

Within this document, the bandwidth of a band-limited acoustic source shall be assumed to be the frequency difference between the half-power frequencies (3 dB loss frequencies) above and below the peak-amplitude-response frequency of the band-limited source.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

What is claimed is:

1. Means for creating a localized low-frequency sound field, comprising:

a housing containing an audio driver including a vibratile diaphragm with first and second sides, and a center, said housing having first, second, third, and fourth exit ports;

first acoustic waveguide means for guiding acoustic energy from said first side of said diaphragm to said first exit port at a first location;

second acoustic waveguide means for guiding acoustic energy from said first side of said diaphragm to said second exit port at a second location, said first and second locations approximately equidistant from said center;

third acoustic waveguide means for guiding acoustic energy from said second side of said diaphragm to said third exit port at a third location;

fourth acoustic waveguide means for guiding acoustic energy from said second side of said diaphragm to said fourth exit port at a fourth location, said third and fourth locations approximately equidistant from said center;

wherein said first, second, third, and fourth locations are all approximately co-linear.

2. Means for creating a localized low-frequency sound field, comprising:

first and second sound modules;

said first sound module comprising:

a first housing containing a first audio driver including a first vibratile diaphragm with first and second sides, and a center, said first housing having first and second exit ports;

first acoustic transmission line waveguide means of length roughly L, for guiding acoustic energy from said first side of said first vibratile diaphragm to a said first exit port at a first location;

second acoustic transmission line waveguide means of length roughly L/2, for guiding acoustic energy from said second side of said first vibratile diaphragm to said second exit port at a second location;

said second sound module comprising:

a second housing containing a second audio driver including a second vibratile diaphragm with first and second sides, and a center, said second housing having third and fourth exit ports;

third acoustic transmission line waveguide means of length roughly L, for guiding acoustic energy from said first side of said second vibratile diaphragm to said third exit port at a third location;

fourth acoustic transmission line waveguide means of length roughly L/2, for guiding acoustic energy from said second side of said second vibratile diaphragm to said fourth exit port at a fourth location;

wherein said first, second, third, and fourth locations are all approximately co-linear, and wherein the distance from said first location to said second location is roughly 0.5 times length L, and wherein the distance from said third location to said fourth location is roughly 0.5 times length L, and wherein the distance from said second location to said fourth location is roughly length L.

* * * * *